US008919455B2

(12) United States Patent
Hendron et al.

(10) Patent No.: US 8,919,455 B2
(45) Date of Patent: Dec. 30, 2014

(54) DOZER BLADE PITCH CONTROL SYSTEM

(75) Inventors: Scott Svend Hendron, Dubuque, IA (US); Jeffrey Alan Bauer, Dubuque, IA (US); Robert Charles Moore, Dickeyville, WI (US)

(73) Assignee: Deere & Company, Moline, IL (US)

( * ) Notice: Subject to any disclaimer, the term of this patent is extended or adjusted under 35 U.S.C. 154(b) by 293 days.

(21) Appl. No.: 12/044,255

(22) Filed: Mar. 7, 2008

(65) Prior Publication Data

US 2009/0223688 A1 Sep. 10, 2009

(51) Int. Cl.

| | |
|---|---|
| ***E02F 3/76*** | (2006.01) |
| ***E02F 3/84*** | (2006.01) |
| ***E02F 9/22*** | (2006.01) |

(52) U.S. Cl.

CPC ..... *E02F 3/844* (2013.01); *E02F 3/7613* (2013.01); *E02F 9/2225* (2013.01); *E02F 3/7618* (2013.01); *E02F 9/2292* (2013.01)

USPC ..... 172/821; 172/2; 172/812

(58) Field of Classification Search

CPC ..... E02F 3/7613; E02F 3/7618; E02F 3/844

USPC ..... 172/2, 3, 7, 810, 811, 812, 819–828, 172/791, 795, 796, 797; 37/348

See application file for complete search history.

(56) References Cited

U.S. PATENT DOCUMENTS

| | | | | |
|---|---|---|---|---|
| 3,705,631 | A * | 12/1972 | Seaberg | 172/812 |
| 4,201,268 | A * | 5/1980 | Frisbee | 172/812 |
| 4,405,019 | A * | 9/1983 | Frisbee | 172/816 |
| 5,634,523 | A * | 6/1997 | Kobayashi et al. | 172/818 |
| 6,041,870 | A * | 3/2000 | Zimmerman et al. | 172/811 |
| 6,247,540 | B1 * | 6/2001 | Clemen et al. | 172/818 |
| 6,273,198 | B1 | 8/2001 | Bauer et al. | |
| 6,955,229 | B1 * | 10/2005 | Hoffart | 172/811 |
| 7,131,502 | B1 * | 11/2006 | Hoffart | 172/821 |

OTHER PUBLICATIONS

"115 Net horsepower J Dozer-700J", Aug. 2001, 16 pgs., John Deere, Moline, Illinois, also available at www.deere.com/en_US/cfd/construction/deere_const/media/pdf/dozer/DKA700J.pdf.

* cited by examiner

*Primary Examiner* — Jamie L McGowan

(74) *Attorney, Agent, or Firm* — Faegre Baker Daniels LLP

(57) ABSTRACT

A vehicle is disclosed having a blade control system. The blade control system is provided to adjust the angle of a blade and to adjust the pitch of the blade. A method for adjusting the pitch of the blade is also disclosed.

24 Claims, 10 Drawing Sheets

DOZER BLADE PITCH CONTROL SYSTEM

BACKGROUND

1. Field of the Invention

The present disclosure relates to a vehicle having a blade control system. More particularly, the present disclosure relates to a vehicle having a blade control system for adjusting the pitch of the blade, and to a method for utilizing the same.

2. Description of the Related Art

Both wheeled and tracked work vehicles, such as bulldozers, may be provided with a forwardly mounted blade for pushing, shearing, carrying, and spreading dirt and other material. The position of the blade may be adjusted by, for example, angling the blade to the right and to the left, and raising and lowering the blade.

The angle that the blade makes with the ground, referred to as the pitch of the blade, may also be adjusted. The pitch of the blade may be adjusted by moving a top portion of the blade forward and backward. As the top portion of the blade is moved backward, the angle between the blade and the ground decreases. As the top portion of the blade is moved forward, the angle between the blade and the ground increases. Minor variations in the pitch of the blade can affect a bulldozer's ability to push, shear, carry, and spread material. For example, a low pitch angle is generally preferred when handling hard, compact soil, while a higher pitch angle is generally preferred when handling soft soil.

SUMMARY

According to an embodiment of the present disclosure, a vehicle is provided that includes a chassis, a ground engaging mechanism designed to support and propel the chassis, and a blade coupled to the chassis. The vehicle further includes at least one hydraulic angling cylinder coupled to the blade to control angling of the blade right and left and a hydraulic pitch cylinder coupled to the blade to control pitching of the blade forward and backward. A hydraulic circuit is provided to direct pressurized fluid to the hydraulic angling cylinder and to the hydraulic pitch cylinder during adjustment of the pitch.

According to another embodiment of the present disclosure, a vehicle is provided that includes a chassis, a ground engaging mechanism designed to support and propel the chassis, and a blade coupled to the chassis. The vehicle further includes an angling mechanism configured to angle the blade right and left and a pitching mechanism configured to pitch the blade forward and backward. An operating means is provided for operating the angling mechanism and the pitching mechanism during adjustment of the pitch.

According to yet another embodiment of the present disclosure, a vehicle is provided that includes a chassis having a central axis and a vertical plane that divides the vehicle along the central axis, and a ground engaging mechanism designed to support and propel the chassis. The vehicle also includes a blade coupled to the chassis such that the vertical plane of the chassis extends through the blade. The blade is configured to angle right and left and to pitch backward and forward relative to the chassis. The vehicle further includes at least one hydraulic cylinder coupled to the blade laterally from the vertical plane. The hydraulic cylinder is configured to provide an input to the blade during adjustment of the pitch.

According to still yet another embodiment of the present disclosure, a method is provided that involves pitching the blade of the vehicle provided. The method includes the steps of providing at least one hydraulic angling cylinder to control angling of the blade right and left and a hydraulic pitch cylinder to control pitching of the blade forward and backward. The method further includes the step of directing pressurized fluid to the hydraulic angling cylinder and to the hydraulic pitch cylinder during adjustment of the pitch.

BRIEF DESCRIPTION OF THE DRAWINGS

The above-mentioned and other features of the present disclosure will become more apparent and the present disclosure itself will be better understood by reference to the following description of embodiments of the present disclosure taken in conjunction with the accompanying drawings, wherein.

Corresponding reference characters indicate corresponding parts throughout the several views. The exemplifications set out herein illustrate exemplary embodiments of the invention and such exemplifications are not to be construed as limiting the scope of the invention in any manner.

DETAILED DESCRIPTION

Figure 1:
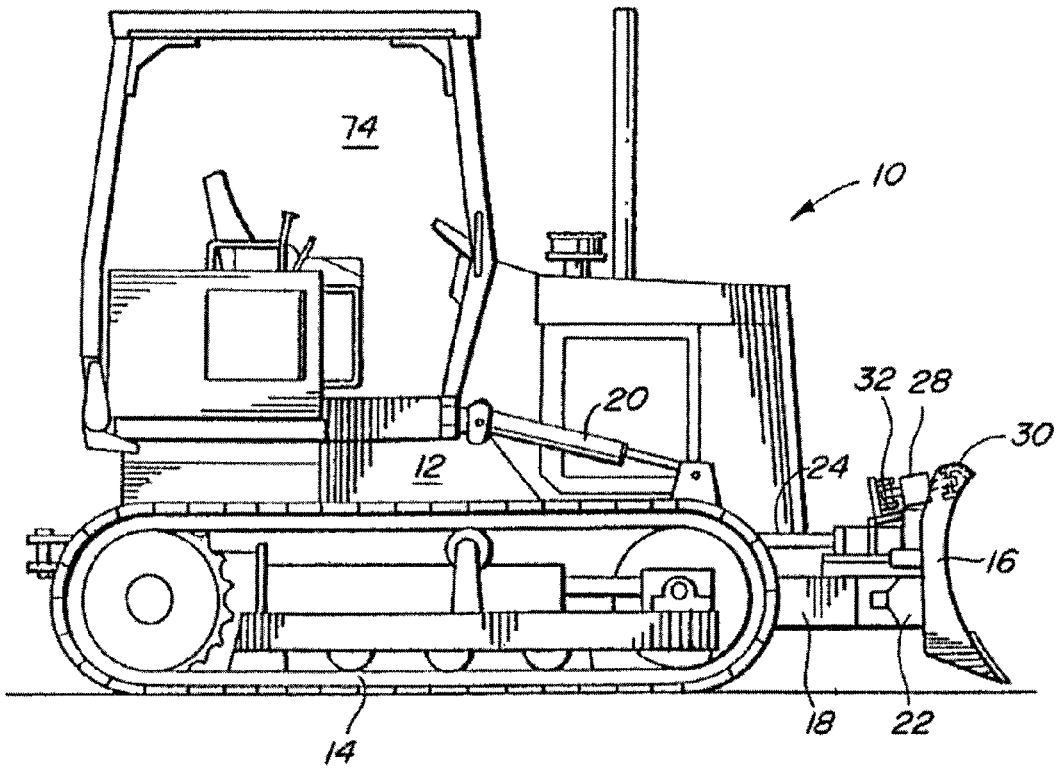
FIG. 1 is a side view of a vehicle having a blade control system of the present disclosure.

Referring to FIG. 1, a work vehicle in the form of bulldozer 10 is provided. Bulldozer 10 includes chassis 12 and ground engaging mechanism 14. Ground engaging mechanism 14 may include any device capable of supporting and propelling chassis 12. For example, as illustrated in FIG. 1, ground engaging mechanism 14 may include belts, such as friction or positively driven rubber belts, or steel tracks. As another example, ground engaging mechanism 14 may include wheels. Bulldozer 10 further includes blade 16 forwardly mounted to chassis 12 for pushing, shearing, carrying, and spreading dirt and other material. Although the vehicle is illustrated and described herein as bulldozer 10, the vehicle may include any type of vehicle having a blade, including motor graders and other known vehicles with blades.

Bulldozer 10 provides a lifting means for raising and lowering blade 16 relative to chassis 12. In an exemplary embodiment of the present disclosure, bulldozer 10 may include blade linkage 18 and at least one hydraulic lift cylinder 20 for raising and lowering blade 16. Blade 16 is coupled to blade linkage 18, which may be in the form of a C-frame structure that is pivotally coupled to chassis 12. Hydraulic lift cylinder 20 is positioned between blade linkage 18 and chassis 12. In operation, as hydraulic lift cylinder 20 is extended or retracted, blade linkage 18, and blade 16 attached thereto, are raised and lowered relative to chassis 12.

Figure 2:
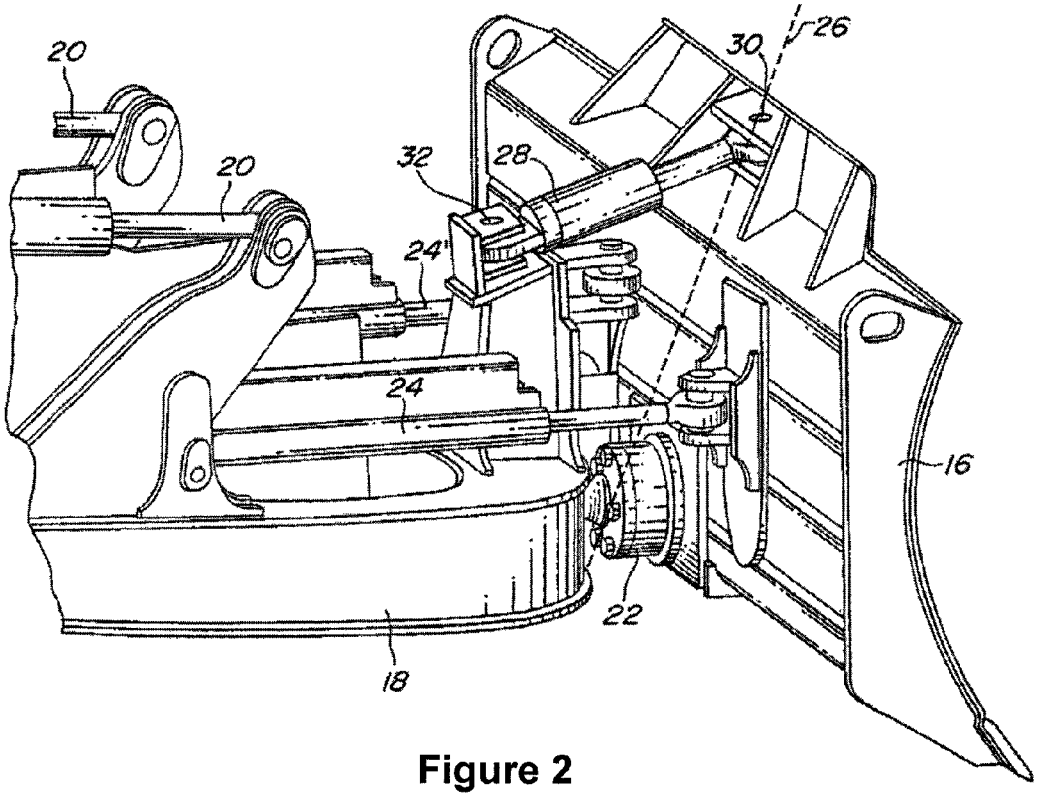
FIG. 2 is a perspective view of a blade linkage and a blade of the vehicle of FIG. 1.

Blade 16 may be coupled to blade linkage 18 by any means known in the art that permits blade 16 to be angled left and right and pitched backward and forward. For example, as shown in FIGS. 1-2, blade 16 may be coupled to blade linkage 18 by spherical bearing 22. Spherical bearing 22 may extend from blade linkage 18 and may be received within blade 16. More specifically, spherical bearing 22 may be received within the bottom portion of blade 16 along central axis 26. Central axis 26 is contained within a vertical plane that extends through bulldozer 10 from back to front and that divides bulldozer 10, including blade 16, into right and left halves.

Referring to FIGS. 1-2, bulldozer 10 also provides an angling means for angling blade 16 right and left relative to blade linkage 18. In an exemplary embodiment of the present disclosure, bulldozer 10 may include at least one hydraulic angling cylinder 24 for angling blade 16 right and left relative to blade linkage 18. Hydraulic angling cylinder 24 is shown in the form of a double acting hydraulic cylinder, however multiple single acting hydraulic cylinders or similar devices may also be used. As illustrated, hydraulic angling cylinder 24 is coupled to blade 16 to the right of central axis 26 and above spherical bearing 22. In operation, as hydraulic angling cylinder 24 is extended, blade 16 angles to the left about spherical bearing 22, and as hydraulic angling cylinder 24 is retracted, blade 16 angles to the right about spherical bearing 22. In another exemplary embodiment of the present disclosure, to further assist in angling blade 16 right and left relative to blade linkage 18, bulldozer 10 may include multiple hydraulic angling cylinders 24, 24'. As illustrated in FIG. 2, two hydraulic angling cylinders 24, 24', are located between blade 16 and blade linkage 18. Both hydraulic angling cylinders 24, 24', are offset from central axis 26, such that one hydraulic angling cylinder 24 is coupled to blade 16 to the right of central axis 26 and the other hydraulic angling cylinder 24' is coupled to blade 16 to the left of central axis 26. In operation, as one hydraulic angling cylinder 24 extends, the other hydraulic angling cylinder 24' retracts, and vice versa. More specifically, as hydraulic angling cylinder 24 located to the right of central axis 26 extends, hydraulic angling cylinder 24' located to the left of central axis 26 retracts, and blade 16 angles to the left about spherical bearing 22. Similarly, as hydraulic angling cylinder 24 located to the right of central axis 26 retracts, hydraulic angling cylinder 24' located to the left of central axis 26 extends, and blade 16 angles to the right about spherical bearing 22.

Referring still to FIGS. 1-2, bulldozer 10 also provides a pitching means for pitching blade 16 forward and backward relative to blade linkage 18. In an exemplary embodiment of the present disclosure, bulldozer 10 may include at least one hydraulic pitch cylinder 28 for pitching blade 16 forward and backward relative to blade linkage 18. Hydraulic pitch cylinder 28 is shown in the form of a double acting hydraulic cylinder, however multiple single acting hydraulic cylinders or similar devices may also be used. Hydraulic pitch cylinder 28 may located between blade 16 and blade linkage 18. As illustrated in FIG. 2, hydraulic pitch cylinder is coupled to blade 16 with pin 30 and to blade linkage 18 with pin 32. However, hydraulic pitch cylinder 28 does not have to be coupled directly to blade 16 and blade linkage 18 and may include intervening linkage operatively coupling the output of hydraulic pitch cylinder 28 to both blade 16 and blade linkage 18. As shown in FIG. 2, unlike hydraulic angling cylinders 24, 24', hydraulic pitch cylinder 28 is aligned with central axis 26. Like hydraulic angling cylinders 24, 24', hydraulic pitch cylinder 28 is coupled to blade 16 above spherical bearing 22. In operation, hydraulic pitch cylinder 28 controls the pitch of blade 16 from the top of blade 16. More specifically, as hydraulic pitch cylinder 28 extends, blade 16 pivots forward about spherical bearing 22 to an upright position. As hydraulic pitch cylinder 28 retracts, blade 16 pivots backward toward chassis 12 about spherical bearing 22 to a "laid back" position.

The embodiment of bulldozer 10 illustrated in FIGS. 1-2 is not intended to limit the scope of the present disclosure. Various components of the lifting means, the angling means, and the pitching means may be rearranged, or other mechanisms may be provided, within the spirit and scope of this disclosure. For example, a single hydraulic angling cylinder 24 could be located to the left of central axis 26. Also, hydraulic pitch cylinder 28 could be located below spherical bearing 22, controlling the pitch of blade 16 from the bottom of blade 16.

As illustrated schematically in FIGS. 3-6, the present disclosure provides a blade control system configured to adjust the angle of blade 16 right and left and to adjust the pitch of blade 16 forward and backward. In an exemplary embodiment of the present disclosure, a hydraulic circuit and an electric circuit are provided to adjust the angle and the pitch of blade 16. As shown, hydraulic fluid from tank 36 is pressurized by pump 38 and directed through supply line S to hydraulic angling cylinders 24, 24', and hydraulic pitch cylinder 28. The path by which pressurized hydraulic fluid flows to hydraulic angling cylinders 24, 24', and hydraulic pitch cylinder 28 is determined by control 34. Exhausted hydraulic fluid from hydraulic angling cylinders 24, 24', and hydraulic pitch cylinder 28 is returned to tank 36. Energy from energy source 68 is supplied to control 34. As with the various physical components of bulldozer 10, such as the lifting means, the angling means, and the pitching means, the blade control system of the present disclosure may be modified within the spirit and scope of the present disclosure. For example, the blade control system may be modified to control the pitch of blade 16 from the bottom of blade 16 rather than the top of blade 16.

Figure 3:
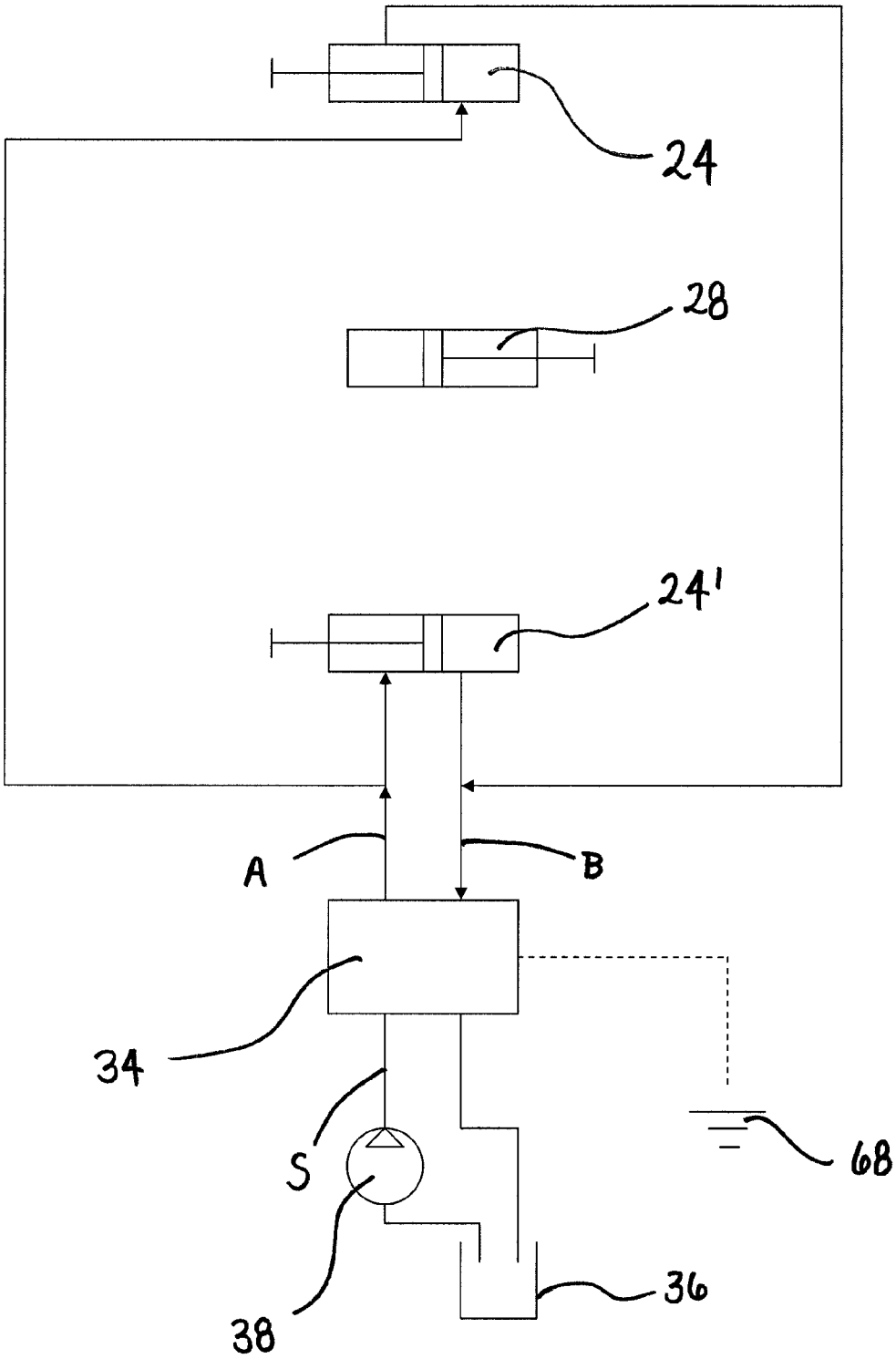
FIG. 3 is a hydraulic and electrical schematic of a blade control system of the present disclosure showing hydraulic fluid flowing to hydraulic angling cylinders in a first direction.
Figure 4:
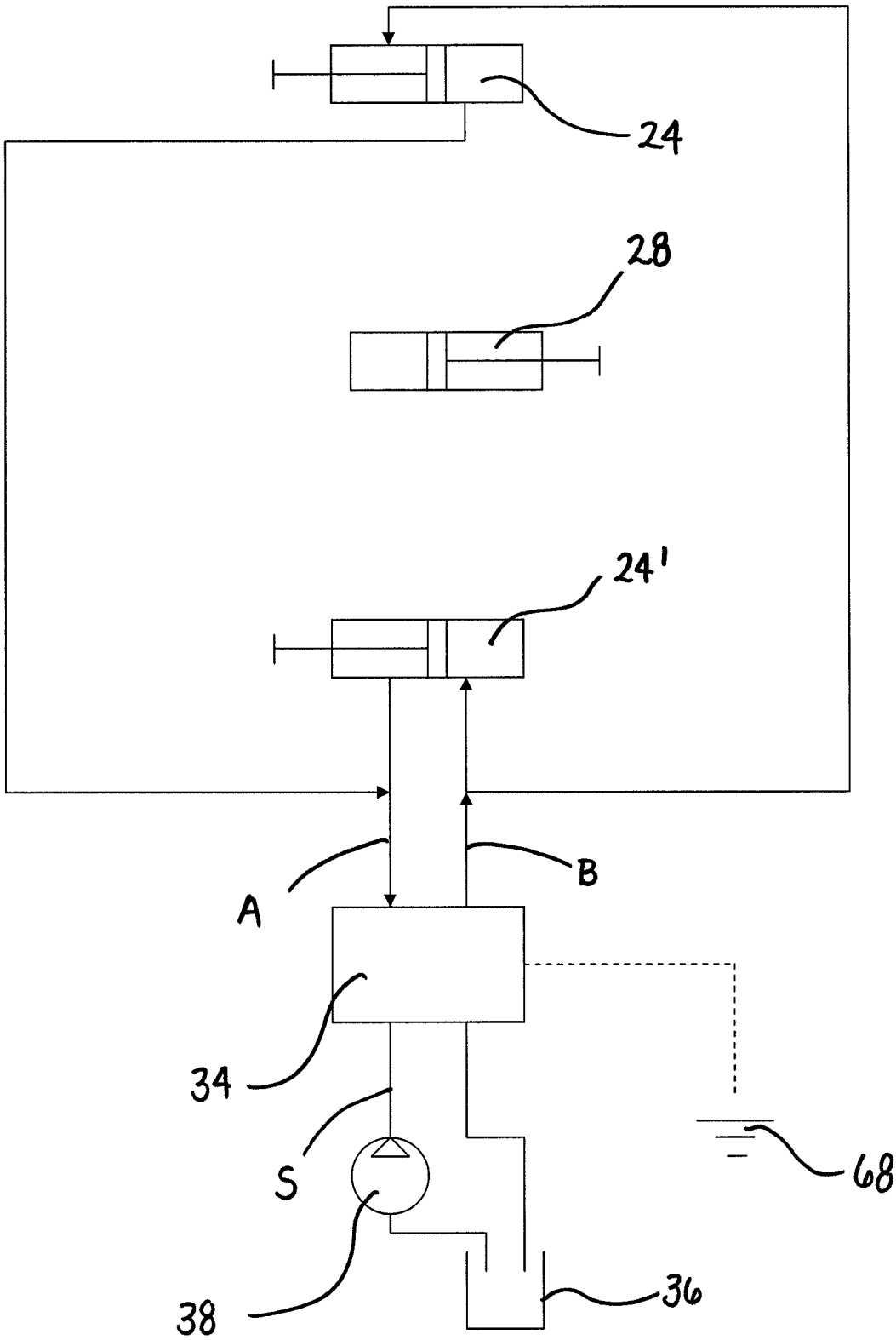
FIG. 4 is a view similar to FIG. 3 showing hydraulic fluid flowing to the hydraulic angling cylinders in a second direction.

During adjustment of the angle of blade 16 right and left (illustrated schematically in FIGS. 3-4), control 34 may direct pressurized hydraulic fluid to hydraulic angling cylinder 24 (and to hydraulic angling cylinder 24', if applicable). FIG. 3 illustrates angling of blade 16 to the left. If a single hydraulic angling cylinder 24 is provided, pressurized hydraulic fluid may flow from supply line S along supply line A to the head port of hydraulic angling cylinder 24, causing hydraulic angling cylinder 24 to extend and blade 16 to angle to the left. If multiple hydraulic angling cylinders 24, 24', are provided, the cylinders may operate in a cross-ported hydraulic arrangement. In other words, pressurized hydraulic fluid may flow from supply line S along supply line A to the head port of hydraulic angling cylinder 24, causing hydraulic angling cylinder 24 to extend, and to the rod port of hydraulic angling cylinder 24', causing hydraulic angling cylinder 24' to retract, and causing blade 16 to angle to the left. FIG. 4 illustrates angling of blade 16 to the right. If a single hydraulic angling cylinder 24 is provided, pressurized hydraulic fluid may flow along supply line B to the rod port of hydraulic angling cylinder 24, causing hydraulic angling cylinder 24 to retract and blade 16 to angle to the right. If multiple hydraulic angling cylinders 24, 24', are provided, the cylinders may operate in a cross-ported hydraulic arrangement. In other words, pressurized hydraulic fluid may flow along supply line B to the rod port of hydraulic angling cylinder 24, causing hydraulic angling cylinder 24 to retract, and to the head port of hydraulic angling cylinder 24', causing hydraulic angling cylinder 24' to extend, and causing blade 16 to angle to the right.

Figure 5:
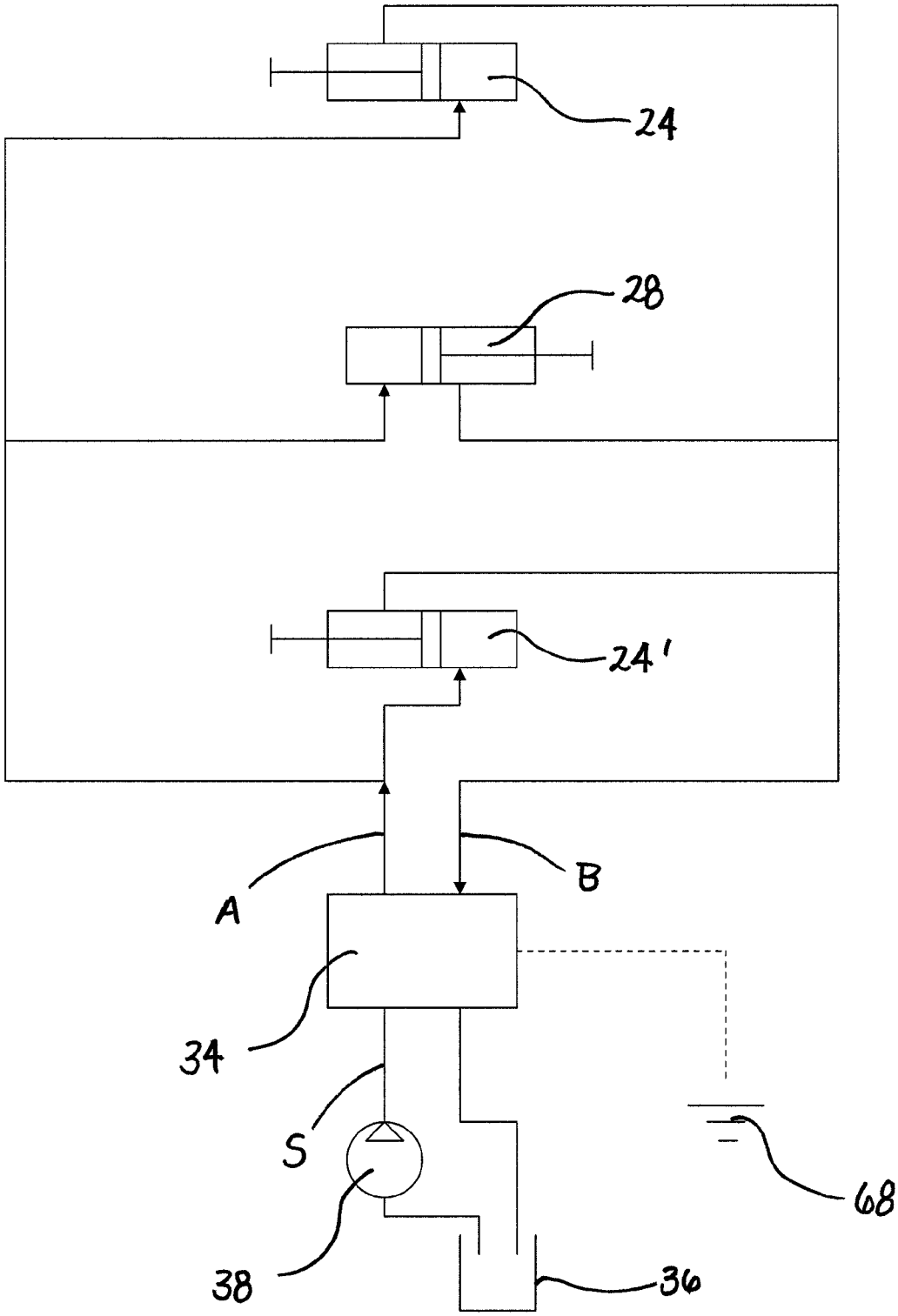
FIG. 5 is a view similar to FIG. 3 showing hydraulic fluid flowing to the hydraulic angling cylinders and a hydraulic pitch cylinder in the first direction.
Figure 6:
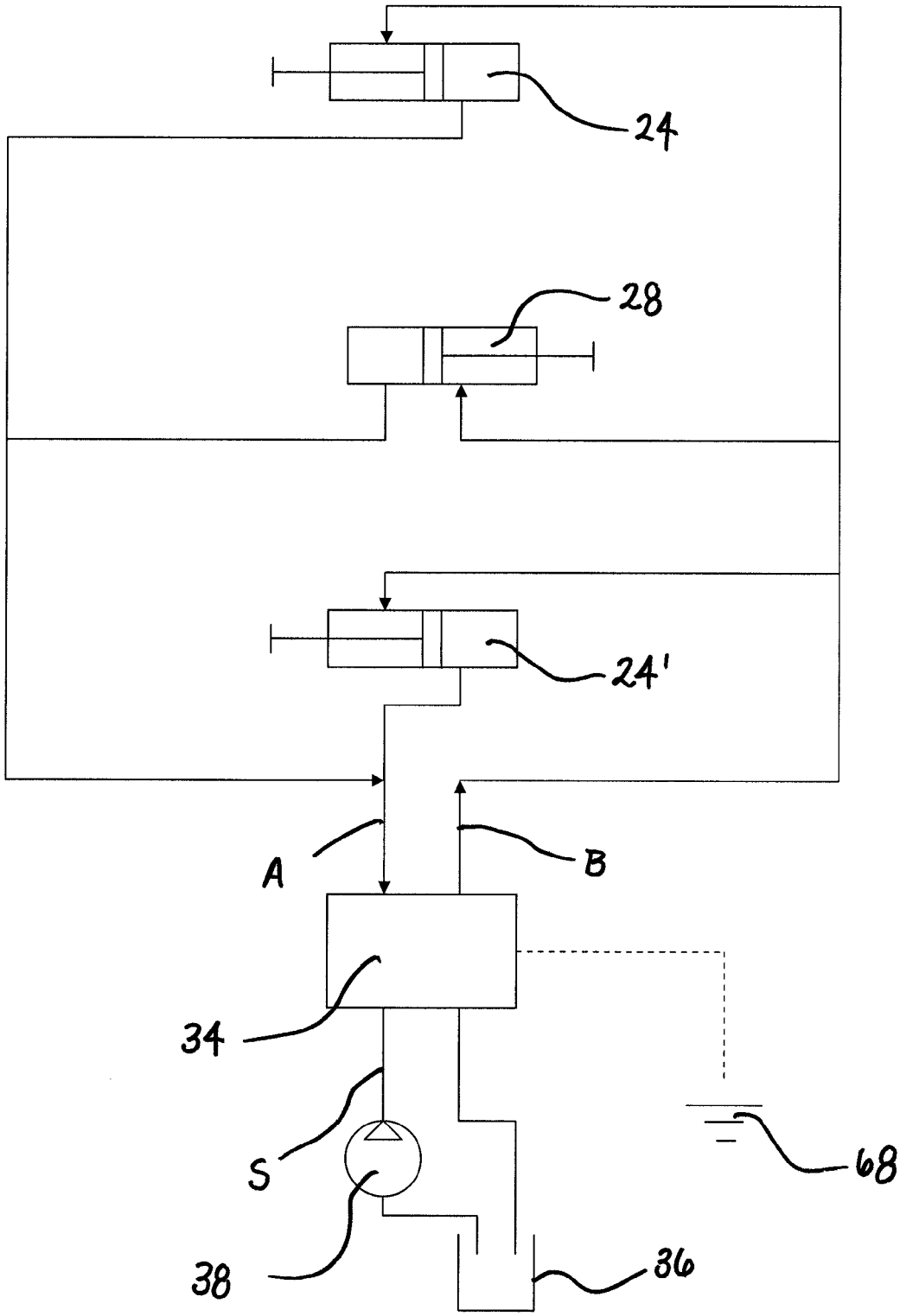
FIG. 6 is a view similar to FIG. 3 showing hydraulic fluid flowing to the hydraulic angling cylinders and the hydraulic pitch cylinder in the second direction.

During adjustment of the pitch of blade 16 forward and backward (illustrated schematically in FIGS. 5-6), control 34 may direct pressurized hydraulic fluid to hydraulic pitch cylinder 28 and to hydraulic angling cylinder 24 (and to hydraulic angling cylinder 24', if applicable). FIG. 5 illustrates pitching of blade 16 forward. If a single hydraulic angling cylinder 24 is provided, hydraulic angling cylinder 24 and hydraulic pitch cylinder 28 may operate in a port-to-port hydraulic arrangement. In other words, pressurized hydraulic fluid may flow from supply line S along supply line A to the head port of hydraulic angling cylinder 24 and the head port of hydraulic pitch cylinder 28, causing both cylinders to extend and blade 16 to pitch forward. If multiple hydraulic angling cylinders 24, 24', are provided, all three cylinders may operate in a port-to-port hydraulic arrangement. In other words, pressurized hydraulic fluid may flow from supply line S along supply line A to the head port of hydraulic angling cylinder 24, the head port of hydraulic angling cylinder 24', and the head port of hydraulic pitch cylinder 28, causing all three cylinders to extend and blade 16 to pitch forward. FIG. 6 illustrates pitching of blade 16 backward. If a single hydraulic angling cylinder 24 is provided, hydraulic angling cylinder 24 and hydraulic pitch cylinder 28 may operate in a port-to-port hydraulic arrangement. In other words, pressurized hydraulic fluid may flow along supply line B to the rod port of hydraulic angling cylinder 24 and the rod port of hydraulic pitch cylinder 28, causing both cylinders to retract and blade 16 to pitch backward. If multiple hydraulic angling cylinders 24, 24', are provided, all three cylinders may operate in a port-to-port hydraulic arrangement. In other words, pressurized hydraulic fluid may flow along supply line B to the rod port of hydraulic angling cylinder 24, the rod port of hydraulic angling cylinder 24', and the rod port of hydraulic pitch cylinder 28, causing all three cylinders to retract and blade 16 to pitch backward.

By pressurizing both hydraulic pitch cylinder 28 and hydraulic angling cylinders 24, 24', rather than only pressurizing hydraulic pitch cylinder 28, a higher force is provided during adjustment of the pitch. This elevated force may allow an operator to adjust the pitch of the blade under full load rather than only under static conditions. Also, the present disclosure utilizes existing hydraulic angling cylinders 24, 24', and existing electric circuitry in operator station 74 of bulldozer 10, rather than requiring new equipment or electric circuitry. Further, the present disclosure reduces or eliminates the need for hydraulic pitch cylinder 28 to be sized large enough to overcome the relief setting of hydraulic angling cylinders 24, 24', and the need for hydraulic angling cylinders 24, 24', to be dumped to tank 36. Finally, the present disclosure enables the use of closed-loop control systems, such as horsepower limiting control systems, rather than relying on typical pump flow reduction-based algorithms.

Referring generally to FIGS. 7-10, the present disclosure provides an operating means in the form of a hydraulic circuit for angling and pitching blade 16. The operating means may include a device that directs the flow of pressurized hydraulic fluid from supply line S to supply lines A and B, such as source control valve 40. Source control valve 40 may be a proportional, four port, three-position directional control valve having first extension position 42, second neutral position 44, and third retraction position 46. As shown, if source control valve 40 is in first extension position 42, pressurized hydraulic fluid is directed to hydraulic angling cylinders 24, 24', and hydraulic pitch cylinder 28 through supply line A; if source control valve 40 is in second neutral position 44, pressurized hydraulic fluid is directed to return to tank 34; and if source control valve 40 is in third retraction position 46, pressurized hydraulic fluid is directed to hydraulic angling cylinders 24, 24', and hydraulic pitch cylinder 28 through supply line B.

Referring still to FIGS. 7-10, the operating means of the present disclosure may further include an opening means for permitting pressurized hydraulic fluid to reach hydraulic pitch cylinder 28 during adjustment of the pitch. The same opening means may restrict pressurized hydraulic fluid from reaching hydraulic pitch cylinder 28 at other times. The opening means may include any device that permits a flow of hydraulic fluid to hydraulic pitch cylinder 28 during adjustment of the pitch.

Referring still to FIGS. 7-10, the operating means of the present disclosure may still further include a switching means for switching hydraulic angling cylinders 24, 24', from a cross-ported to a port-to-port hydraulic arrangement. The switching means permits cooperation between hydraulic angling cylinders 24, 24', during adjustment of the pitch. The switching means may include any device that places hydraulic angling cylinders 24, 24', in a port-to-port hydraulic arrangement during adjustment of the pitch. More simply, the switching means may include any device that reverses the ordinary direction of flow to hydraulic angling cylinder 24' during adjustment of the pitch. For example, if pressurized hydraulic fluid flows to the rod port of hydraulic angling cylinder 24' during adjustment of the angle, switching means may cause the fluid to flow to the head port of hydraulic angling cylinder 24' during adjustment of the pitch.

The following paragraphs set forth exemplary embodiments of the operating means. More specifically, the following paragraphs set forth exemplary embodiments of the opening means and the switching means. Such embodiments are not to be construed as limiting the scope of the opening means or the switching means.

Figure 7:
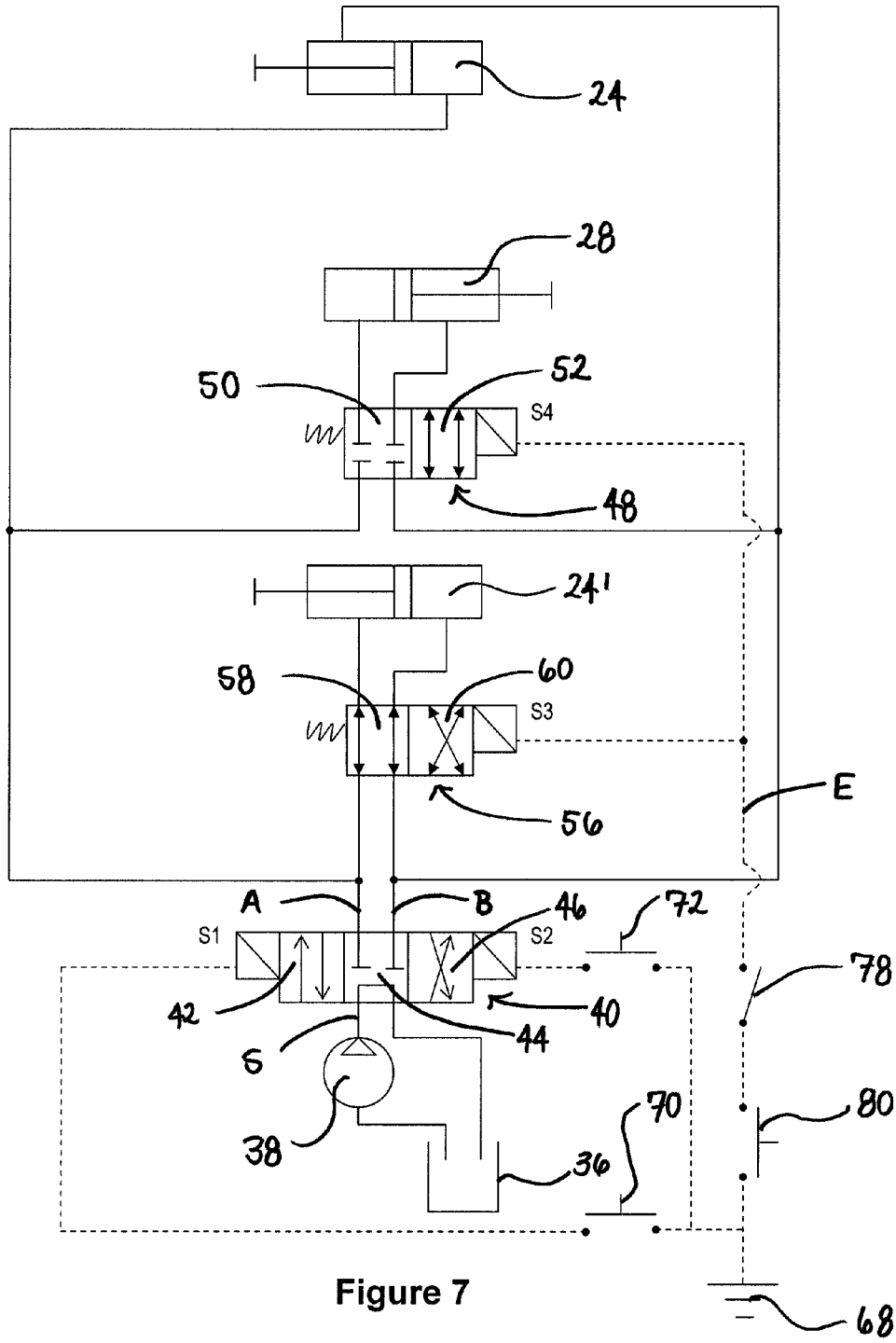
FIG. 7 is a hydraulic and electrical schematic of a blade control system of the present disclosure.

According to an embodiment of the present disclosure, illustrated in FIG. 7, the opening means may include pitch control valve 48 hydraulically positioned along both supply line A and supply line B. Pitch control valve 48 may be solenoid actuated, as shown, or pitch control valve 48 may be pilot operated. Pitch control valve 48 may be a four port, two-position directional control valve having first closed position 50 and second open position 52. If pitch control valve 48 is in first closed position 50, pressurized hydraulic fluid is prevented from flowing through supply line A or B to hydraulic pitch cylinder 28. On the other hand, if pitch control valve 48 is in second open position 52, pressurized hydraulic fluid is directed through supply line A or B to hydraulic pitch cylinder 28. Therefore, pitch control valve 48 may be biased toward first closed position 50 and may switch to second open position 52 during adjustment of the pitch.

Referring still to the embodiment of FIG. 7, the switching means may include switch control valve 56. Switch control valve 56 may be solenoid actuated. As shown, switch control valve 56 may be a four-port, two-position directional control valve having first normal position 58 and second reverse position 60. If pressurized hydraulic fluid is directed through supply line A and switch control valve 56 is in first normal position 58, the fluid flows along angle path X to the rod port of hydraulic angling cylinder 24'. On the other hand, if pressurized hydraulic fluid is directed through supply line A and switch control valve 56 is in second reverse position 60, the fluid flows along pitch path Y to the head port of hydraulic angling cylinder 24'. Similarly, if pressurized hydraulic fluid is directed through supply line B and switch control valve 56 is in first normal position 58, the fluid flows along angle path X' to the head port of hydraulic angling cylinder 24'. On the other hand, if pressurized hydraulic fluid is directed through supply line B and switch control valve 56 is in second reverse position 60, the fluid flows along pitch path Y' to the rod port of hydraulic angling cylinder 24'. In this embodiment, pitch path Y' for hydraulic fluid flowing through supply line B may be the same as angle path X for hydraulic fluid flowing through supply line A, and vice versa. In operation, switch control valve 56 may be biased toward first normal position 58 and may switch to second reverse position 60 during adjustment of the pitch.

Figure 8:
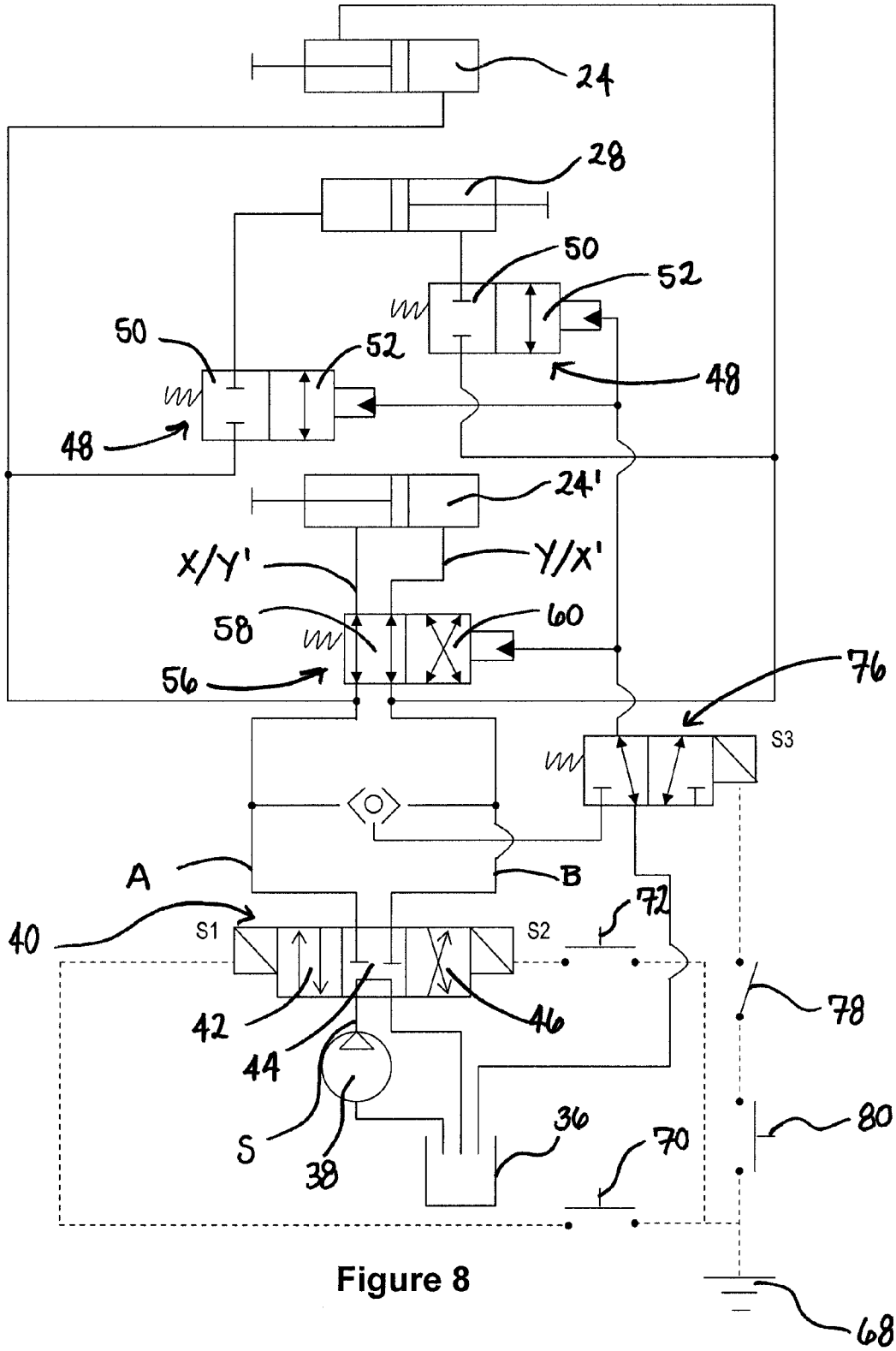
FIG. 8 is a hydraulic and electrical schematic of an alternative blade control system of the present disclosure.

According to another embodiment of the present disclosure, illustrated in FIG. 8, the opening means may include more than one pitch control valve 48. One pitch control valve 48 may be hydraulically positioned along supply line A, while another pitch control valve 48 may be hydraulically positioned along supply line B. Pitch control valves 48 may be pilot operated, as shown, or pitch control valves 48 may be solenoid actuated. Each pitch control valve 48 may be a two-port, two-position directional control valve having first closed position 50 and second open position 52. If pitch control valve 48 positioned along supply line A, for example, is in first closed position 50, pressurized hydraulic fluid is prevented from flowing through supply line A to hydraulic pitch cylinder 28. On the other hand, if the same pitch control valve 48 is in second open position 52, pressurized hydraulic fluid is directed through supply line A to hydraulic pitch cylinder 28. Therefore, pitch control valves 48 may be biased toward first closed position 50 and may switch to second open position 52 during adjustment of the pitch.

Referring still to the embodiment of FIG. 8, the switching means may include switch control valve 56. Unlike switch control valve 56 of FIG. 7, switch control valve 56 of FIG. 8 may be pilot operated. Like switch control valve 56 of FIG. 7, switch control valve 56 of FIG. 8 may be a four-port, two-position directional control valve having first normal position 58 and second reverse position 60. If pressurized hydraulic fluid is directed through supply line A and switch control valve 56 is in first normal position 58, the fluid flows along angle path X to the rod port of hydraulic angling cylinder 24'. On the other hand, if pressurized hydraulic fluid is directed through supply line A and switch control valve 56 is in second reverse position 60, the fluid flows along pitch path Y to the head port of hydraulic angling cylinder 24'. Similarly, if pressurized hydraulic fluid is directed through supply line B and switch control valve 56 is in first normal position 58, the fluid flows along angle path X' to the head port of hydraulic angling cylinder 24'. On the other hand, if pressurized hydraulic fluid is directed through supply line B and switch control valve 56 is in second reverse position 60, the fluid flows along pitch path Y' to the rod port of hydraulic angling cylinder 24'. In this embodiment, pitch path Y' for hydraulic fluid flowing through supply line B may be the same as angle path X for hydraulic fluid flowing through supply line A, and vice versa. In operation, switch control valve 56 may be biased toward first normal position 58 and may switch to second reverse position 60 during adjustment of the pitch.

Figure 9:
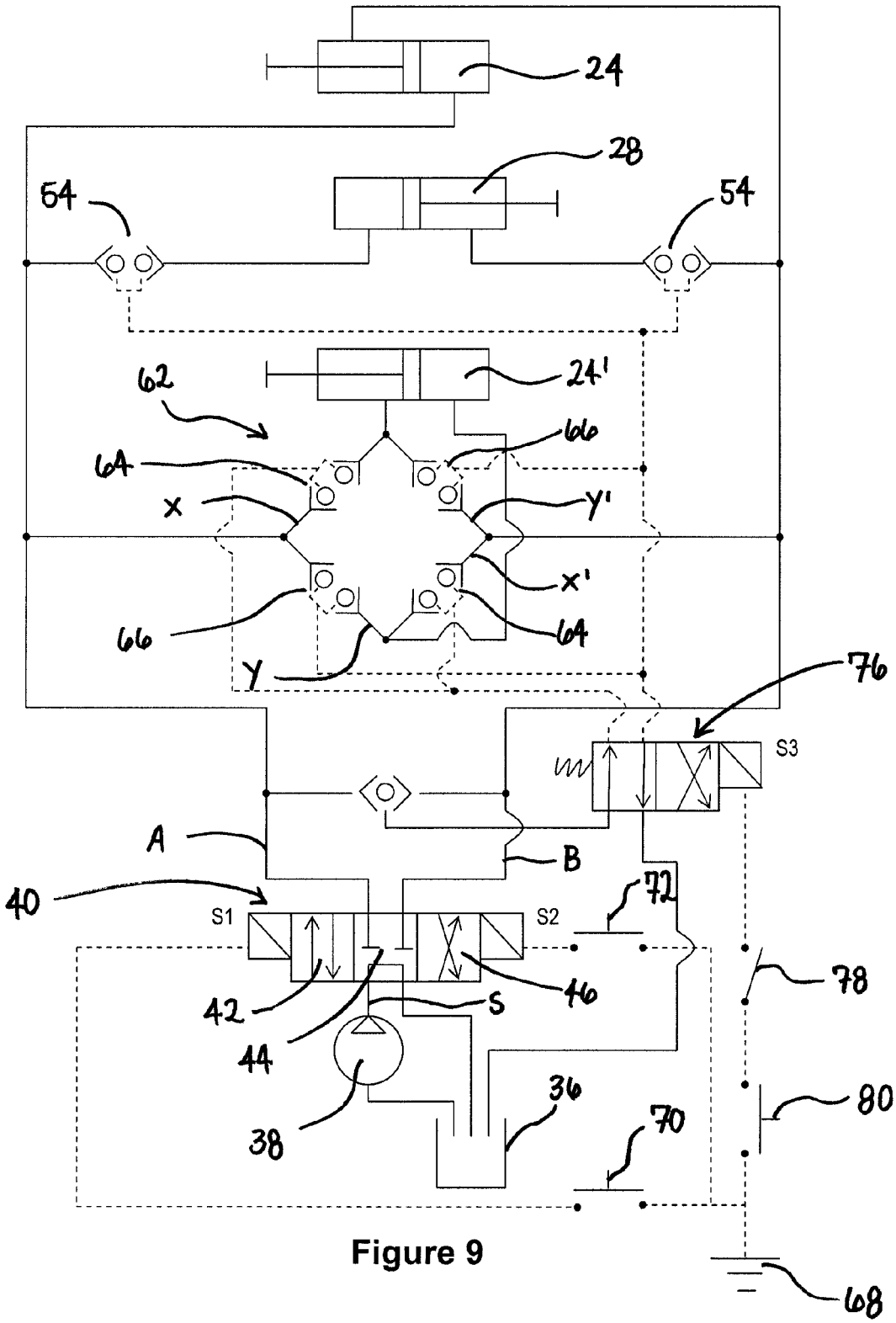
FIG. 9 is a hydraulic and electrical schematic of an alternative blade control system of the present disclosure.

According to yet another embodiment of the present disclosure, illustrated in FIG. 9, the opening means may include pitch check valves 54 hydraulically positioned along supply lines A and B. Pitch check valves 54 may be pilot operated, as shown, or pitch check valves 54 may be solenoid actuated. Pitch check valves 54 may be biased in a closed position, preventing fluid flowing through supply lines A and B from reaching hydraulic pitch cylinder 28. During adjustment of the pitch, however, pitch check valves 54 may shift to an open position, permitting fluid flowing through lines A and B to reach hydraulic pitch cylinder 28.

Referring still to the embodiment of FIG. 9, the switching means may include switch check valves 62. Switch check valves 62 may be pilot operated, as shown, or switch check valves 62 may be solenoid actuated. Switch check valves 62 may include angle path valves 64 and pitch path valves 66. Angle path valves 64 may be positioned along angle path X, in which fluid from supply line A flows to the rod port of hydraulic angling cylinder 24', and along angle path X', in which fluid from supply line B flows to the head port of hydraulic angling cylinder 24'. Pitch path valves 66 may be positioned along pitch path Y, in which fluid from supply line A flows to the head port of hydraulic angling cylinder 24', and along pitch path Y', in which fluid from supply line B flows to the rod port of hydraulic angling cylinder 24'. During adjustment of the angle, angle path valves 64 may be open while pitch path valves 66 may be closed. During adjustment of the pitch, on the other hand, angle path valves 64 may switch closed to block angle paths, X and X', and pitch path valves 66 may switch open to open pitch paths, Y and Y'.

Figure 10:
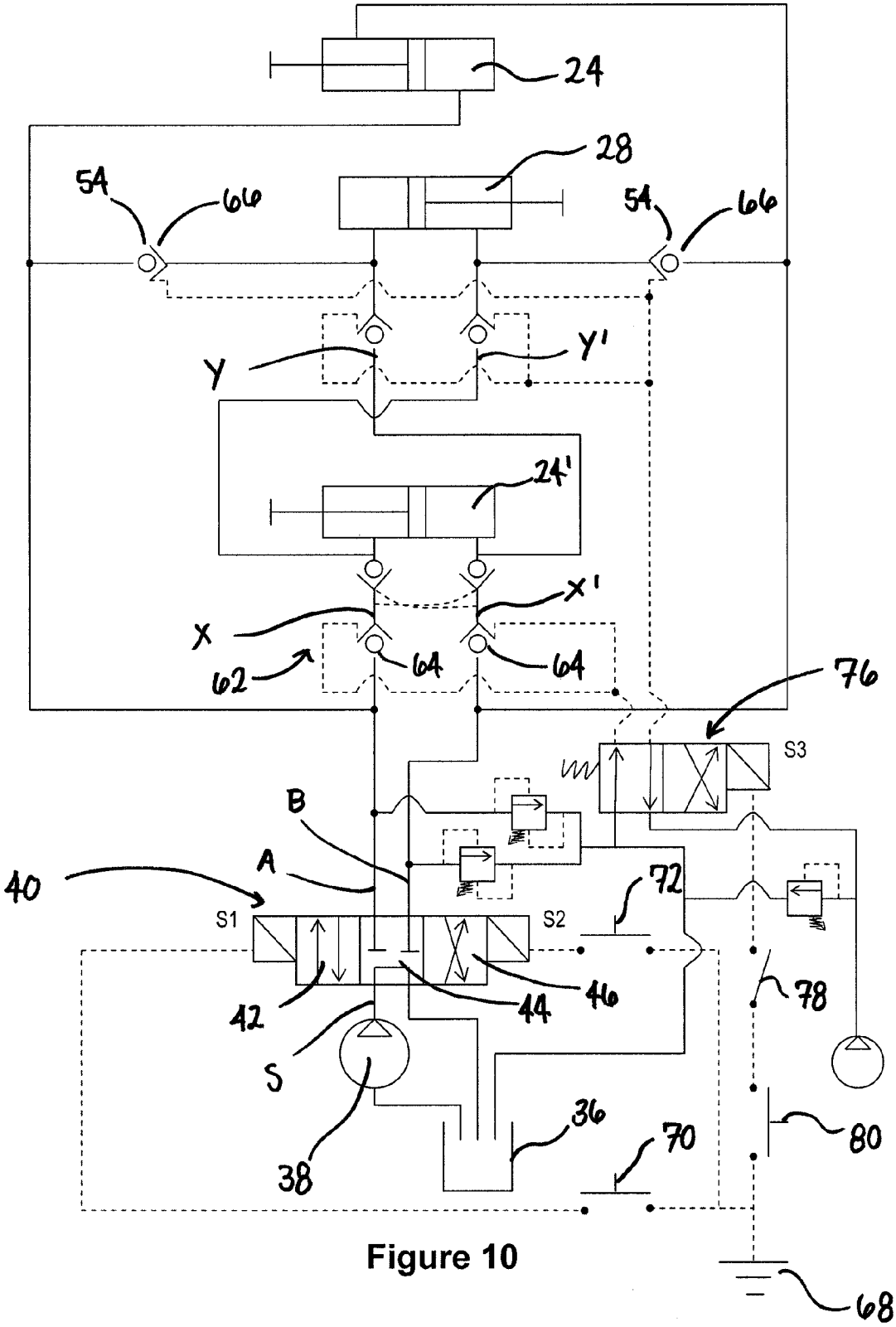
FIG. 10 is a hydraulic and electrical schematic of an alternative blade control system of the present disclosure.

According to still yet another embodiment of the present disclosure, illustrated in FIG. 10, the opening means may include pitch check valves 54 hydraulically positioned along supply lines A and B, like the embodiment of FIG. 9. Pitch check valves 54 may be pilot operated, as shown, or pitch check valves 54 may be solenoid actuated. Pitch check valves 54 may be biased in a closed position, preventing fluid flowing through supply lines A and B from reaching hydraulic pitch cylinder 28. During adjustment of the pitch, however, pitch check valves 54 may shift to an open position, permitting fluid flowing through lines A and B to reach hydraulic pitch cylinder 28.

Referring still to the embodiment of FIG. 10, the switching means may include switch check valves 62. Switch check valves 62 may be pilot operated, as shown, or switch check valves 62 may be solenoid actuated. Switch check valves 62 may include angle path valves 64 and pitch path valves 66. During adjustment of the angle, angle path valves 64 may be open while pitch path valves 66 may be closed. During adjustment of the pitch, on the other hand, angle path valves 64 may switch closed to block angle paths, X and X', and pitch path valves 66 may switch open to open pitch paths, Y and Y'. As shown, pitch path valves 66 may eliminate the need for separate pitch check valves 54. In this embodiment, pitch path valves 66 may open both the path to hydraulic pitch cylinder 28 and pitch paths, Y and Y', to hydraulic angling cylinder 24'.

The previous paragraphs set forth exemplary embodiments of the operating means for angling and pitching blade 16. The present disclosure further provides an enabling means for supplying energy to the operating means and for enabling adjustment of the pitch. Referring back to FIGS. 3-6, the enabling means may include an electric circuit to supply energy from energy source 68 to control 34. During adjustment of the angle of blade 16 right and left (illustrated schematically in FIGS. 3-4), energy may be supplied to control 34 to operate hydraulic angling cylinders 24, 24'. During adjustment of the pitch of blade 16 forward and backward (illustrated schematically in FIGS. 5-6), energy may be supplied to control 34 to operate hydraulic angling cylinders 24, 24', and hydraulic pitching cylinder 28.

The following paragraphs set forth exemplary embodiments of the enabling means. Such embodiments are not to be construed as limiting the scope of the enabling means.

According to an embodiment of the present disclosure, illustrated in FIG. 7, energy may be supplied to source control valve 40 during adjustment of the angle. Source control valve 40 may be provided with first solenoid S1 and second solenoid S2. If first solenoid S1 is energized, source control valve 40 is shifted to first extension position 42, which directs pressurized hydraulic fluid from pump 38 to supply line A. Similarly, if second solenoid S2 is energized, source control valve 40 is shifted to third retraction position 46, which directs pressurized hydraulic fluid from pump 38 to supply line B. The circuit between first solenoid S1 and energy source 68 may be interrupted by left angling switch 70, and the circuit between second solenoid S2 and energy source 68 may be interrupted by right angling switch 72.

In operation, when a user engages left angling switch 70, energy is directed to first solenoid S1, which shifts source control valve 40 to first extension position 42, directs pressurized hydraulic fluid to supply line A, and causes blade 16 to angle to the left. Similarly, when a user engages right angling switch 72, energy is directed to second solenoid S2, which shifts source control valve 40 to third retraction position 46, directs pressurized hydraulic fluid to supply line B, and causes blade 16 to angle to the right. Both left angling switch 70 and right angling switch 72 may be located on a T-bar in operator station 74 of bulldozer 10 for ease of operation (FIG. 1).

Referring still to the embodiment of FIG. 7, during adjustment of the pitch, energy may be supplied to source control valve 40 as it was during adjustment of the angle. Additionally, energy may be supplied to solenoids of the opening means and the switching means. More specifically, energy may be supplied to third solenoid S3 of pitch control valve 48 and fourth solenoid S4 of switch control valve 56. Circuit path E, which travels between energy source 68 and third solenoid S3 and fourth solenoid S4, may be interrupted by relay switch 78 and pitch activating switch 80. Relay switch 78 closes whenever left angling switch 70 or right angling switch 72 is engaged. Along with left angling switch 70 and right angling switch 72, pitch activating switch 80 may be located on a T-bar in operator station 74 of bulldozer 10 (FIG. 1).

In operation, when a user engages only pitch activating switch 80, circuit path E remains open. When a user engages both pitch activating switch 80 and left angling switch 70, relay switch 78 closes circuit path E, such that energy is directed to first solenoid S1, third solenoid S3, and fourth solenoid S4. Pressurized hydraulic fluid is supplied through supply line A, which causes hydraulic angling cylinder 24 to extend. The fluid encounters pitch control valve 48 in second open position 52, which causes hydraulic pitch cylinder 28 to extend. If applicable, the fluid also encounters switch control valve 56 in second reverse position 60, which causes hydraulic angling cylinder 24' to extend. The extension of hydraulic angling cylinders 24, 24', and hydraulic pitch cylinder 28 causes blade 16 to pitch forward to an upright position. Similarly, when a user engages both pitch activating switch 80 and right angling switch 72, relay switch 78 closes circuit path E, such that energy is directed to second solenoid S2, third solenoid S3, and fourth solenoid S4. Pressurized hydraulic fluid is supplied through supply line B, which causes hydraulic angling cylinder 24 to retract. The fluid encounters pitch control valve 48 in second open position 52, which causes hydraulic pitch cylinder 28 to retract. If applicable, the fluid also encounters switch control valve 56 in second reverse position 60, which causes hydraulic angling cylinder 24' to retract. The retraction of hydraulic angling cylinders 24, 24', and hydraulic pitch cylinder 28 causes blade 16 to pitch backward to a "laid back" position.

According to other embodiments of the present disclosure, illustrated in FIGS. 8-10, energy may be supplied to source control valve 40 during adjustment of the angle as it was in FIG. 7. Like the embodiment of FIG. 7, source control valve 40 may be provided with first solenoid S1 and second solenoid S2. Also, like the embodiment of FIG. 7, the circuit between first solenoid S1 and energy source 68 may be interrupted by left angling switch 70, and the circuit between second solenoid S2 and energy source 68 may be interrupted by right angling switch 72.

Referring still to the embodiments of FIGS. 8- 10, during adjustment of the pitch, energy may be supplied to source control valve 40 as it was during adjustment of the angle. Additionally, energy may be supplied to one or more pilot devices 76, which in turn operate the opening means and the switching means. More specifically, energy may be supplied to third solenoid S3 of pilot device 76, and pilot device 76 may shift to a position in which pressurized fluid or air is supplied to operate the opening means and the switching means. As shown in FIG. 8, energized pilot device 76 may supply pressurized fluid to pitch control valve 48 and switch control valve 56. As shown in FIG. 9, energized pilot device 76 may supply pressurized air to pitch check valves 54 and switch check valves 62. As shown in FIG. 10, energized pilot device 76 may supply pressurized air to pitch check valves 54 and switch check valves 62. The circuit between energy source 68 and third solenoid S3 of pilot device 76 may be interrupted by relay switch 78 and pitch activating switch 80. Relay switch 78 closes whenever left angling switch 70 or right angling switch 72 is engaged. Along with left angling switch 70 and right angling switch 72, pitch activating switch 80 may be located on a T-bar in operator station 74 of bulldozer 10 (FIG. 1).

In operation, when a user engages only pitch activating switch 80, the electric circuit between energy source 68 and third solenoid S3 remains open. When a user engages both pitch activating switch 80 and left angling switch 70, relay switch 78 closes the circuit between energy source 68 and third solenoid S3, such that energy is directed to both first solenoid S1 and third solenoid S3. Pressurized hydraulic fluid is supplied through supply line A, which causes hydraulic angling cylinder 24 to extend. The fluid encounters the opening means operated by pilot device 76, which causes hydraulic pitch cylinder 28 to extend. More specifically, as shown in FIG. 8, the fluid encounters pitch control valves 48 in second open position 52. As shown in FIGS. 9 and 10, the fluid encounters pitch check valve 54 in an open position. If applicable, the fluid also encounters the switching means operated by pilot device 76, which causes hydraulic angling cylinder 24' to extend. More specifically, as shown in FIG. 8, the fluid encounters switch control valve 56 in second reverse position 60. As shown in FIGS. 9 and 10, the fluid encounters pitch path valves 66 in an open position and angle path valves 64 in a closed position. The extension of hydraulic angling cylinders 24, 24', and hydraulic pitch cylinder 28 causes blade 16 to pitch forward to an upright position. Similarly, when a user engages both pitch activating switch 80 and right angling switch 72, relay switch 78 closes the circuit between energy source 68 and third solenoid S3, such that energy is directed to both second solenoid S2 and third solenoid S3. Pressurized hydraulic fluid is supplied through supply line B, which causes hydraulic angling cylinder 24 to retract. The fluid encounters the opening means described above, which causes hydraulic pitch cylinder 28 to retract. If applicable, the fluid also encounters the switching means described above, which causes hydraulic angling cylinder 24' to retract. The retraction of hydraulic angling cylinders 24, 24', and hydraulic pitch cylinder 28 causes blade 16 to pitch backward to a "laid back" position.

While this invention has been described as having preferred designs, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A vehicle including:
- a chassis;
- a ground engaging mechanism configured to support and propel the chassis;
- a blade coupled to the chassis;
- at least one hydraulic angle cylinder coupled to the blade and configured to control angling of the blade right and left;
- a hydraulic pitch cylinder coupled to the blade and configured to control pitching of the blade forward and backward; and
- a hydraulic circuit comprising:
  - a hydraulic fluid source;
  - a main control valve positioned downstream of the hydraulic fluid source;
  - a junction positioned downstream of the main control valve;
  - a first flow path between the junction and the at least one hydraulic angle cylinder to provide hydraulic fluid from the junction to the at least one hydraulic angle cylinder;
  - a second flow path between the junction and the hydraulic pitch cylinder to provide hydraulic fluid from the junction to the hydraulic pitch cylinder; and
  - a pitch control valve positioned downstream of the junction along the second flow path, the pitch control valve having a closed configuration that closes the second flow path during angling of the blade and an open configuration that opens the second flow path during pitching of the blade.

2. The vehicle of claim 1, wherein the pitch control valve is biased in the closed configuration.

3. The vehicle of claim 1, further including an angle control valve positioned downstream of the junction along the first flow path, the angle control valve having a first configuration that directs hydraulic fluid to a head port of the at least one hydraulic angle cylinder and a second configuration that directs hydraulic fluid to a rod port of the at least one hydraulic angle cylinder.

4. The vehicle of claim 3, wherein the angle control valve switches between the first and second configurations during pitching of the blade.

5. The vehicle of claim 3, wherein the angle control valve includes a plurality of check valves.

6. The vehicle of claim 1, further including a second hydraulic angle cylinder coupled to the blade and configured to control angling of the blade right and left, wherein the hydraulic circuit further includes a third flow path between the junction and the second hydraulic angle cylinder to provide hydraulic fluid from the junction to the second hydraulic angle cylinder.

7. The vehicle of claim 6, further including a second junction positioned between the second and third flow paths.

8. The vehicle of claim 6, wherein the at least one hydraulic angle cylinder and the second hydraulic angle cylinder operate in a cross-ported hydraulic arrangement during angling of the blade and in a port-to-port hydraulic arrangement during pitching of the blade.

9. The vehicle of claim 1, wherein the at least one hydraulic angle cylinder and the hydraulic pitch cylinder operate in a port-to-port hydraulic arrangement during pitching of the blade.

10. The vehicle of claim 1, wherein the pitch control valve includes a two-position valve.

11. The vehicle of claim 1, wherein the pitch control valve includes a plurality of check valves.

12. The vehicle of claim 1, wherein the main control valve has a forward configuration, a reverse configuration, and a closed configuration.

13. The vehicle of claim 6, further including:
- a pitch activating input;
- a blade control input that controls angling of the blade when the pitch activating input is deactivated and pitching of the blade when the pitch activating input is activated.

14. The vehicle of claim 13, wherein the pitch activating input is coupled to the blade control input.

15. The vehicle of claim 6, wherein the hydraulic circuit combines hydraulic fluid exhausted from the hydraulic angle cylinder with hydraulic fluid exhausted from the hydraulic pitch cylinder before returning the hydraulic fluid to the hydraulic fluid source.

16. A vehicle including:
- a chassis;
- a ground engaging mechanism configured to support and propel the chassis;
- a blade coupled to the chassis;
- at least one hydraulic angle cylinder coupled to the blade and configured to control angling of the blade right and left;
- a hydraulic pitch cylinder coupled to the blade and configured to control pitching of the blade forward and backward; and
- a hydraulic circuit including:
  - a first control valve in fluid communication with the at least one hydraulic angle cylinder; and
  - a second control valve in fluid communication with the hydraulic pitch cylinder; and
- a control circuit including:
  - an energy source;
  - a first control switch that operably couples the energy source to the first control valve during angling of the blade, the first control switch automatically closing a relay switch between the energy source and the second control valve; and
  - a second control switch that operably couples the energy source to the second control valve during pitching of the blade when the relay switch is closed.

17. The vehicle of claim 16, wherein the first control valve is also in fluid communication with the hydraulic pitch cylinder.

18. The vehicle of claim 16, wherein the first control valve has a forward configuration, a reverse configuration, and a closed configuration.

19. The vehicle of claim 16, wherein the second control valve has a closed configuration and an open configuration.

20. The vehicle of claim 16, further including an angle control valve having a first configuration that directs hydraulic fluid to a head port of the at least one hydraulic angle cylinder and a second configuration that directs hydraulic fluid to a rod port of the at least one hydraulic angle cylinder.

21. The vehicle of claim 16, wherein the hydraulic circuit operates the at least one hydraulic angle cylinder and the hydraulic pitch cylinder during pitching of the blade.

22. The vehicle of claim 16, wherein the first and second control switches are located together in an operator station of the vehicle.

23. The vehicle of claim 16, wherein the control circuit further includes a third control switch, the first control switch controlling angling of the blade right and the third control switch controlling angling of the blade left.

24. The vehicle of claim 16, wherein the control circuit further includes a third control switch that automatically closes the relay switch.

* * * * *